US007134411B2

(12) United States Patent
Lancefield et al.

(10) Patent No.: US 7,134,411 B2
(45) Date of Patent: Nov. 14, 2006

(54) VALVE OPERATING MECHANISM

(75) Inventors: Timothy Mark Lancefield, Shipston on Stour (GB); Nicholas James Lawrence, Buckingham (GB); Ian Methley, Witney (GB); Mark Andrew Richard Walton, Bicester (GB)

(73) Assignee: Mechadyne PLC, Oxfordshire (GB)

( * ) Notice: Subject to any disclaimer, the term of this patent is extended or adjusted under 35 U.S.C. 154(b) by 0 days.

(21) Appl. No.: 11/284,725

(22) Filed: Nov. 21, 2005

(65) Prior Publication Data

US 2006/0112914 A1 Jun. 1, 2006

(30) Foreign Application Priority Data

Dec. 1, 2004 (GB) ..... 0426352.1

(51) Int. Cl.
*F01L 1/18* (2006.01)

(52) U.S. Cl. ..... 123/90.4; 123/90.41; 123/90.39

(58) Field of Classification Search ..... 123/90.4, 123/90.41, 90.39
See application file for complete search history.

(56) References Cited

U.S. PATENT DOCUMENTS 5,732,670 A * 3/1998 Mote, Sr. ..... 123/90.24

* cited by examiner

*Primary Examiner*—Thomas Denion
*Assistant Examiner*—Zelalem Eshete
(74) *Attorney, Agent, or Firm*—Smith-Hill and Bedell

(57) ABSTRACT

A valve operating mechanism is described for an internal combustion engine in which at least one valve (14) of an engine cylinder is operated by two cams (10,12). The cams (10,12) have respective cam followers (38,36) which are resiliently biased to remain in contact with the cams (10,12) at all times and which act on the valve (14) by way of a summation linkage (20,24) in such a manner that the displacement of the valve (14) at any instant is determined by a combination of the displacements of the two cam followers (38,36). In the invention, movement of each of the two cam followers (38,36) is transmitted to the summation linkage (20,24) by way of a respective one of two pushrods (28,30).

11 Claims, 6 Drawing Sheets

VALVE OPERATING MECHANISM

CROSS REFERENCE TO RELATED APPLICATION

This application claims priority under 35 USC 119 of United Kingdom Patent Application No. 0426352.1 filed Dec. 1, 2004.

FIELD OF THE INVENTION

The present invention relates to a valve operating mechanism for an internal combustion engine in which at least one valve of an engine cylinder is operated by two cams, wherein the cams have respective cam followers which are resiliently biased to remain in contact with the cams at all times, the cams acting on the valve by way of a summation linkage mounted on the engine cylinder head in such a manner that the displacement of the valve at any instant is determined by a combination of the displacements of the two cam followers.

BACKGROUND OF THE INVENTION

EP 1426569 discloses such a valve operating system having overhead cams and the relative phasing of the two cams is used to adjust, amongst other things, valve event duration.

The aim of the present invention is to implement such a system in a pushrod engine (i.e. an engine in which the cams are arranged within the engine cylinder block) where movement of the cam followers is transmitted to the valves through pushrods and rockers.

The difficulty that such a valve operating system presents when using pushrods is that there is inevitably a significant clearance in the system when a valve is closed and both of its cam followers are on the base circles of their respective cams. Steps must therefore be taken to ensure that the pushrods always remain within their sockets in the cam followers and in the valve operating rockers.

SUMMARY OF THE INVENTION

In accordance with the present invention, there is provided a valve operating mechanism for an internal combustion engine in which at least one valve of an engine cylinder is operated by two cams, wherein the cams have respective cam followers which are resiliently biased to remain in contact with the cams at all times, the cams acting on the valve by way of a summation linkage mounted on the engine cylinder head in such a manner that the displacement of the valve at any instant is determined by a combination of the displacements of the two cam followers, characterised in that movement of each of the two cam followers is transmitted to the summation linkage by way of a respective one of two pushrods.

U.S. Pat. No. 5,555,860 describes an engine in which a valve is operated by two cams arranged within the engine block. In the latter patent, a summation lever is arranged adjacent the cams in the engine block and a single pushrod is used to transmit the motion of the summation lever to the associated valve by way of a rocker. The control mechanism of the latter patent differs from that of the present invention in that it is not used to achieve variable event duration. Instead variable valve lift is achieved by arranging for the summation lever to be in permanent engagement with one of the cams and spaced from the base circle of the second cam by a gap. Such a gap would be totally inadmissible in the present invention.

The present invention offers the advantage of bringing to pushrod engines the advantages of a variable valve operating mechanism that have hitherto only been achievable in an overhead camshaft (OHC) engine, in which the cams are mounted in the cylinder head.

In one embodiment of the invention, the two cams are mounted on separate camshafts that are spaced from, and extend parallel to, one another.

Alternatively, the two cams may be mounted coaxially with one another as part of a single assembled camshaft.

The summation linkage may comprise a rocker mounted on a fixed pivot, one side of the rocker acting on the valve and its opposite side pivotally supporting a summation lever acted upon by the two pushrods. Alternatively, the summation linkage may consist of a rocker mounted on a fixed pivot, one side of the rocker being acted upon by one of the pushrods and its opposite side pivotally supporting a lever which engages the valve and is acted upon by the other pushrod.

In order to ensure that each of the pushrods remains permanently in contact at one end with the summation linkage and at the other end with its cam follower, the summation linkage may be resiliently biased by a torsion spring or a compression spring. Alternatively, one of the cam followers or one of the pushrods may be formed of two parts that are resiliently biased apart.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
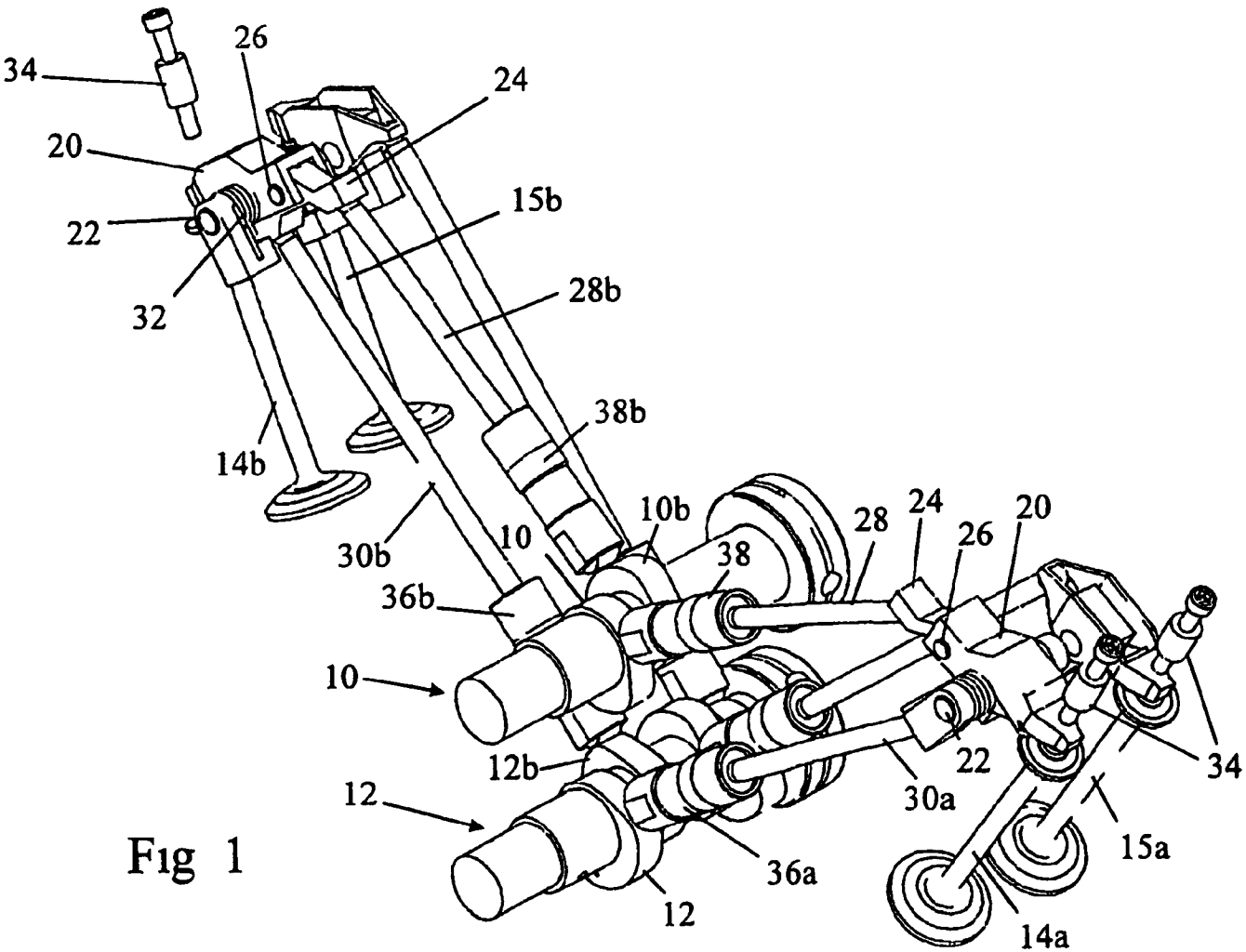
FIG. 1 is a schematic perspective view of a valve operating mechanism using two spaced camshafts and employing a first configuration of summation linkage.

FIG. 1 shows a valve operating mechanism having two camshafts 10 and 12 mounted in an engine having two mutually inclined banks of cylinders, commonly referred to as a 'V' engine. The engine cylinder block and cylinder heads have all been omitted from the drawings in the interest of clarity, only two intake poppet valves 14*a*, 14*b* and two exhaust poppet valves 15*a*, 15*b* being shown in the drawing. The exhaust poppet valves 15*a* and 15*b* are each operated in a conventional manner by a single cam on the camshaft 12 and their operation need not be described further. The intake valves 14*a* and 14*b*, on the other hand, are each operated by combining the effect of two cams, one mounted on the camshaft 12 and the other on the camshaft 10.

At least one of the camshafts 10 and 12 is coupled for rotation with the crankshaft by way of a phaser (not shown in the drawings) to allow the phase of the camshafts 10 and 12 to be varied relative to one another. As is well known, a phaser is a coupling that rotates the camshaft in synchronism with the crankshaft (at half the speed in the case of a four-stroke engine) but allows some degree of rotation of the camshaft relative to the crankshaft to vary to the phase of the cams mounted on the camshaft in relation to the engine operating cycle. Several phasers are disclosed in the prior art, suitable examples being hydraulically operated vane-type phasers that can be incorporated in the cogs or pulleys driving the camshafts.

Each of the intake valves 14*a*, 14*b* is operated by a rocker 20 mounted in one of the two cylinder heads on a stationary rocker shaft 22. One end of each rocker 20 acts on the tip of the stem of the associated valve 14 to open and close the valve. The other end of each rocker 20 carries a double ended summation lever 24 which is pivotable relative to the rocker 20 about a pin 26.

In the case of the valve designated 14*a*, its summation lever 24 is acted upon at one end by a pushrod 30*a* whose other end is in contact with a cam follower 36*a* riding on a cam 12*a* of the camshaft 12. The other end of the same summation lever is acted upon by the cam 10*a* of the camshaft 10 by way of a cam follower 38*a* and a pushrod 28*a*.

Similarly for the valve designated 14*b*, its summation lever 24 is acted upon at one end by a pushrod 30*b* whose other end is in contact with a cam follower 36*b* riding on a cam 12*b* of the camshaft 12 and the other end of the same summation lever is acted upon by the cam 10*b* of the camshaft 10 by way of a cam follower 38*b* and a pushrod 28*b*.

Thus, for each of the valves 14, the associated summation lever 24 is acted upon at its opposite ends by two pushrods each associated with a cam on a respective one of the two camshafts 10, 12.

Figure 10D:
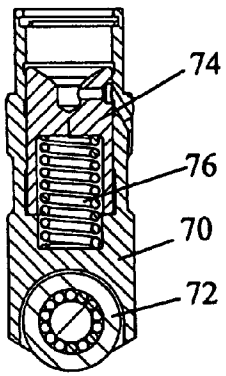
FIGS. 10*c* and 10*d* are sections through a spring biased cam follower in its extended and fully collapsed position, respectively.
Figure 10C:
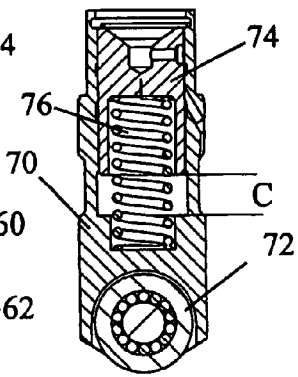
Figure 10B:
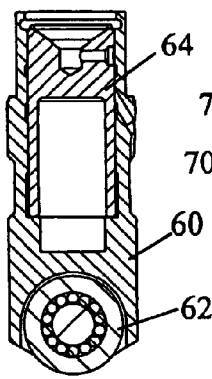
FIG. 10*b* is a section through a fixed cam follower.
Figure 10A:
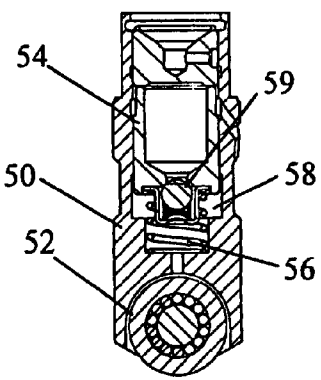
FIG. 10*a* shows a section through a hydraulic cam follower incorporating a spring.

A torsion spring 32 acts on each rocker 20 and one of the cam followers 36, 38 is of the type shown in FIG. 10*a* which includes a hydraulic lash adjuster, the other being a fixed cam follower of the construction shown in FIG. 10*b*. An adjustable stop 34 limits the maximum clearance.

The cam follower of FIG. 10*a* has a main body 50 carrying a roller 52. A piston 54 reciprocable within the main body is biased by a spring 56 and forms the movable wall of a hydraulic working chamber 58 into which engine oil is admitted through a non-return valve 59. The cam follower of FIG. 10*b* has a body 60 carrying a roller 62 but its piston 64 does not move and for this reason the cam follower is termed a fixed cam follower. The spring 32 and the hydraulic cam follower together ensure that the ends of the pushrods remain at all times in their sockets in the summation lever 24 and in the cam followers.

Figure 2:
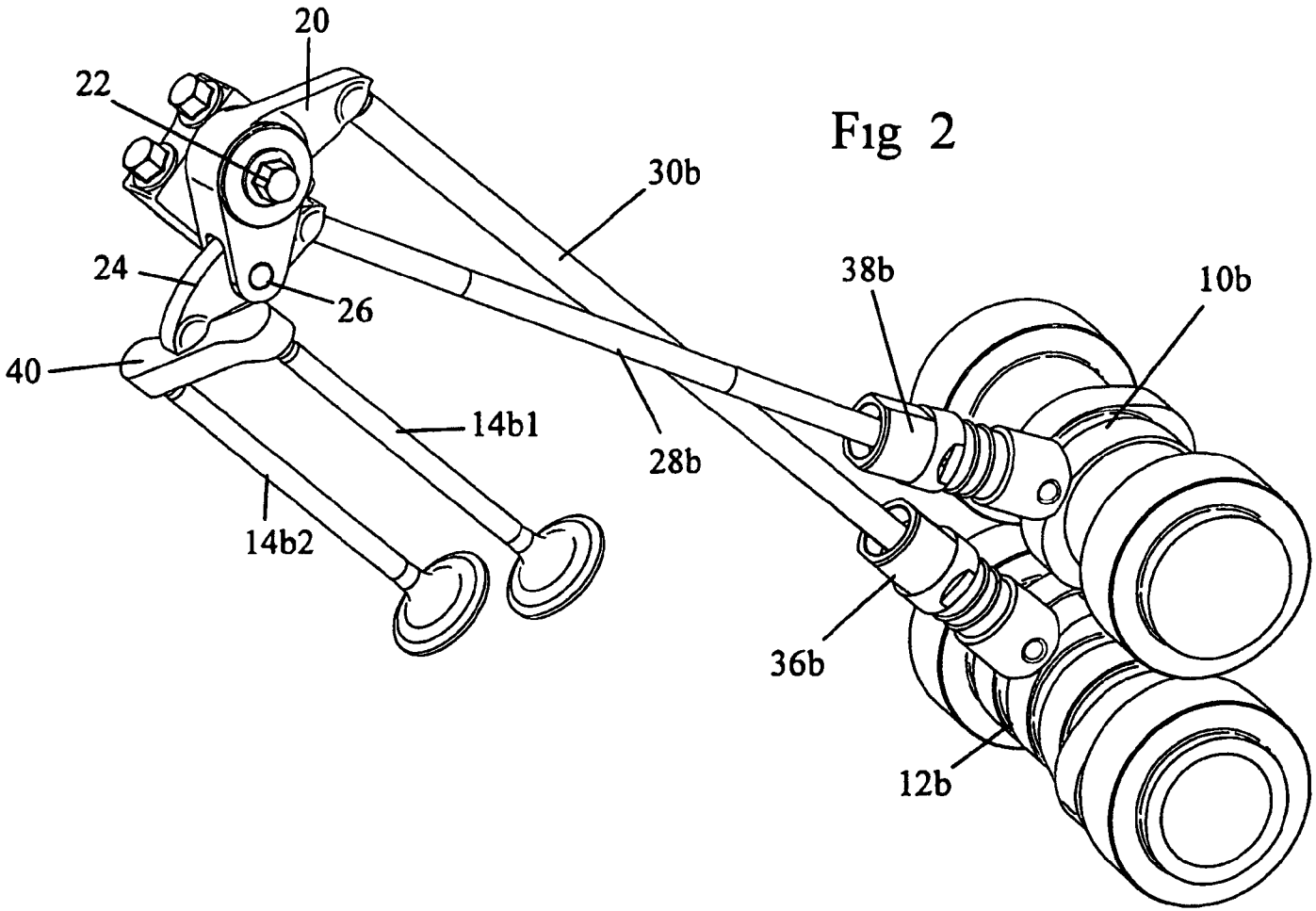
FIG. 2 is a schematic perspective view of a valve operating mechanism using two spaced camshafts and employing a second configuration of summation linkage.

The embodiment shown in FIG. 2 operates on a similar principle to that of FIG. 1 but relies on an alternative summation linkage for combining the two cam follower motions transmitted via the pushrods. The embodiment of FIG. 2 replaces the rocker 20 and the summation lever 24 by a first rocker 20' having a fixed pivot point 22' and a second rocker 24' pivotable relative to the first rocker 22' about a pivot 26' carried by the first rocker 20'. One of the pushrods 30*b* acts on the free end of the rocker 20', the other pushrod 28*b* acts on one end of the rocker 24' and the opposite end of the rocker 24' acts on two intake valve 14*b*1 and 14*b*2 by way of a bridge 40 which overlies the tops of the stems of both valves.

The operation of this summation linkage, which is believed to be clear from the foregoing description is further explained within the context of an OHC engine in EP 1426569.

Figure 4:
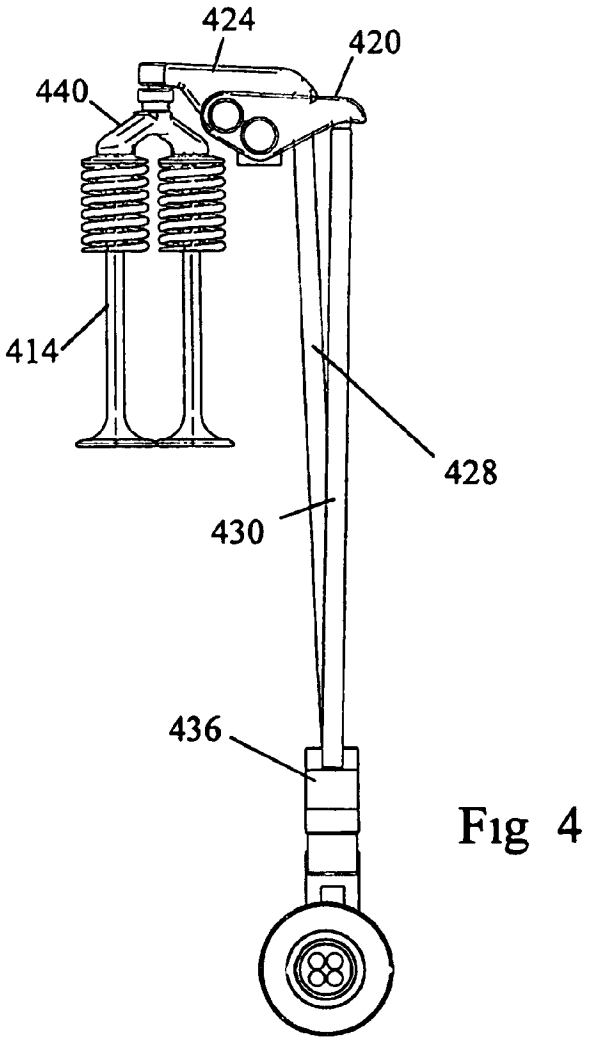
FIGS. 3 and 4 are schematic perspective and sides views, respectively, of a valve operating mechanism using coaxial cams and employing the same configuration of summation linkage as shown in FIG. 2.
Figure 3:
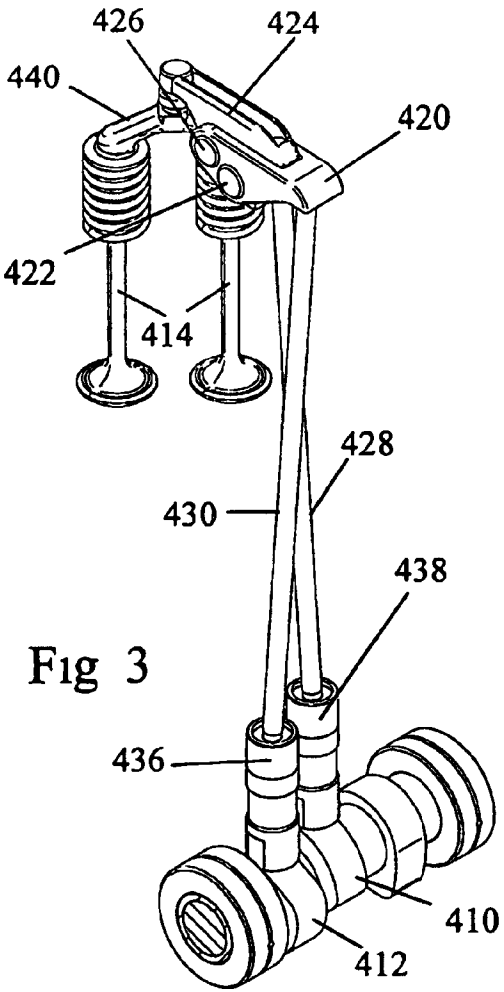

The embodiment of the invention shown in FIGS. 3 and 4 uses concentric cams 410, 412 with followers 436, 438 and separate pushrods 428, 430 to operate a summation linkage similar to that shown in FIG. 2. The use of similar reference numerals in the 400 series is used to avoid repeating the description of the summation linkage.

In the embodiments of FIG. 2 and of FIGS. 3 and 4, a torsion spring and a hydraulic cam follower may once again be used to take up free play and to ensure that ends of the pushrods do not come away from their sockets at any time.

Figure 6:
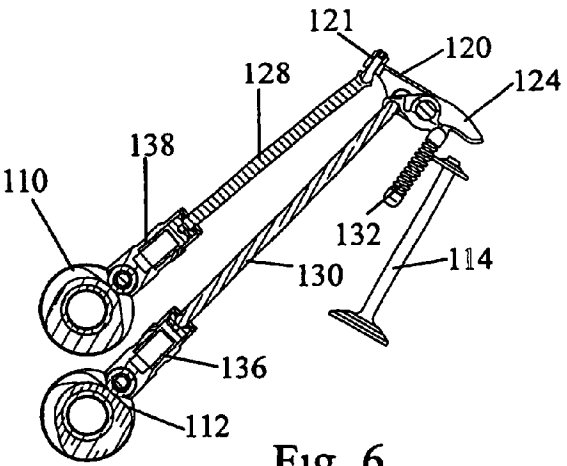
FIGS. 6 and 7 show sections through the embodiment illustrated in FIG. 5 in different positions of the cams.
Figure 5:
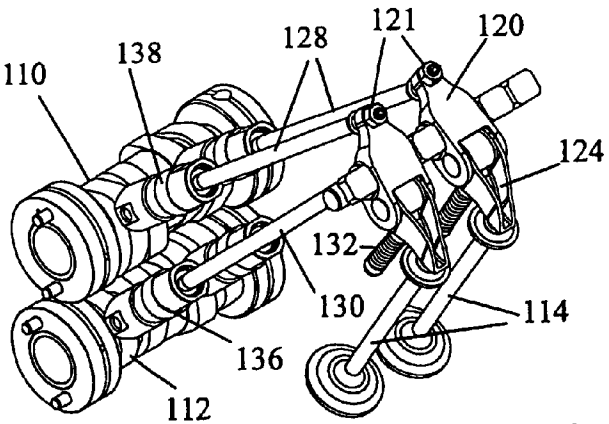
FIG. 5 is a view similar to that of FIG. 2 showing an embodiment of the invention in which the summation linkage is biased by a compression spring.
Figure 7:
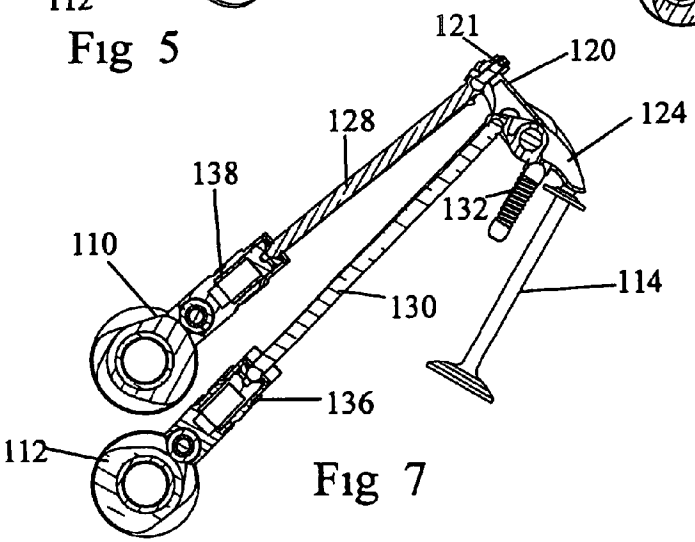

FIGS. 5, 6 and 7 show an embodiment operating in the same manner as that of FIG. 2 and, to avoid repetition, like parts are designated by like reference numerals but in the 100 series. FIG. 5 shows a perspective view of the valve operating mechanism while FIG. 6 shows a section through the mechanism when both cams are on their base circles and the spring 132 has opened a clearance between the valve 114 and the rocker 124. FIG. 7 shows the same section when one of the cams is at maximum lift, bringing the rocker 124 back into contact with the valve 114 at the point of valve opening. The essential difference in this embodiment of the invention is that the torsion spring 32 has been replaced by a helical compression spring 132 which, as shown in FIG. 6, biases both the summation lever 124 and the rocker 120 counter-clockwise to open a gap between the summation lever 124 and the valve 114 while maintaining contact with the push-rods 128 and 130 at both ends. In this embodiment also, the rocker 120 has been fitted with a manual adjuster 121 for controlling the clearance in the system. The manual adjuster removes the need for either of the cam followers to be fitted with a hydraulic lash adjuster.

Figure 9:
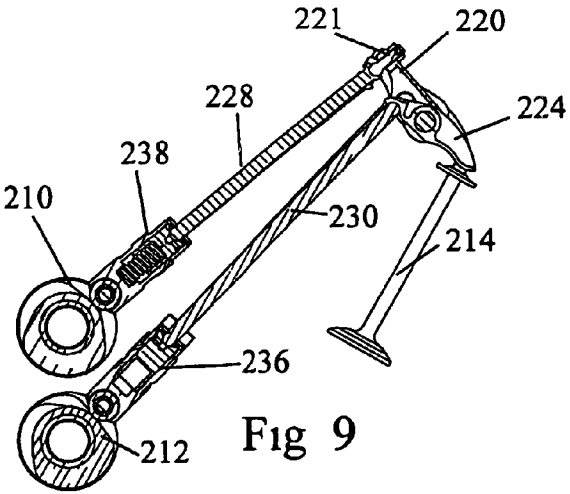
FIGS. 8 and 9 are views similar to the sections of FIGS. 6 and 7 of a further embodiment of the invention in which a spring is mounted in one of the cam followers in place of the spring acting on the summation linkage.
Figure 8:
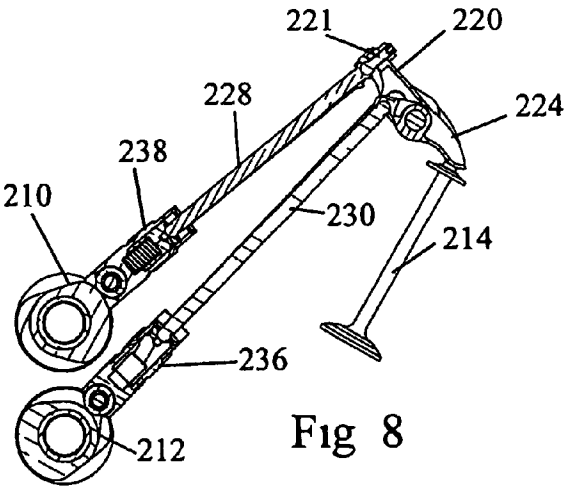

In the case of the embodiment of FIGS. 8 and 9, which use like reference numerals in the 200 series to designate like parts, the springs 32 and 132 of the previously described embodiments, which act on the summation linkage, are replaced by a spring 76 arranged in one of the cam followers 238, which is constructed in the manner shown in FIGS. 10*c* and 10*d*. The other cam follower 236 is of the same fixed design as used in the previously described embodiments and shown in FIG. 10*b*.

The sprung cam follower shown in FIGS. 10*c* and 10*d* comprises a body 70 carrying a follower roller 72. A piston 74 slidable in the main body 70 is biased by a spring 76 so that the cam follower can be extended, as shown in FIG. 10*c* or contracted, as shown in FIG. 10*d*. In this case, the summation lever 224 remains in contact with the valve stem 214 at all times and the clearance "C" in the system appears within between the main body 70 and the piston 74 of the cam follower.

Figures 11A, 11B, 11C, 11D:
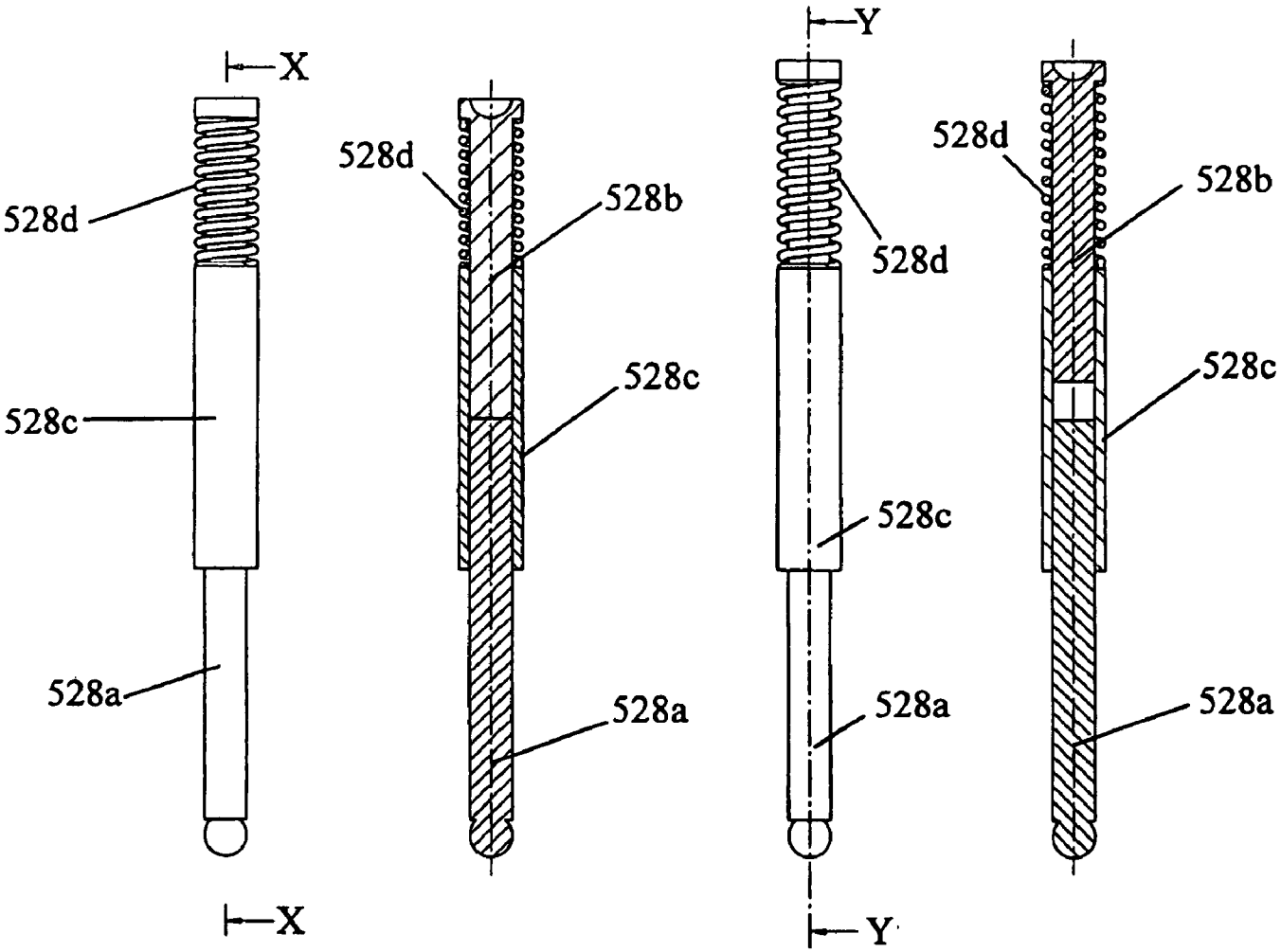
FIG. 11*a* is a side view of a spring biased collapsible pushrod in its collapsed state.
FIG. 11*b* is a section along the section plane X—X in FIG. 11*a*.
FIG. 11*c* is a side view of the pushrod of FIG. 11*a* in its extended position.
FIG. 11*d* is a section along the section plane Y—Y ins FIG. 11*c*.

The embodiment of FIGS. 8 and 9 may use an extendable pushrod in place of an extendable cam follower to achieve the same effect. Such an extendable pushrod 528528, which would replace the fixed length push rod 228 is shown in its collapsed state in FIGS. 11*a* and 11*b*. The pushrod is formed in two parts 528*a* and 528*b* which can slide relative to one another and are maintained in alignment by means of a sleeve 528*c* which is permanently attached to the lower part 528*a* of the pushrod. A spring 528*d* acts in a direction to separate the two parts and extend the pushrod into the position shown in FIGS. 11*c* and 11*d*.

It will be clear from the various embodiments described above that the invention does not reside in the design of the summation linkage employed to combine the actions of the two cams but in the fact that the combining of the action of two cams is carried out within the context of a pushrod engine.

In operation, a phaser is attached to each of the two cams to allow the phase of the cams to be adjusted relative to the engine crankshaft. By altering the relative phase of two cams acting on the same intake valve it is possible to vary the valve event duration and the valve lift. Furthermore, when both cams can be independently phased relative to the crankshaft, it is possible to modify the timing of the valve event with the engine cycle.

The invention claimed is:

1. A valve operating mechanism for an internal combustion engine having an engine cylinder and a gas flow valve associated with the cylinder, the valve operating mechanism comprising:

two cams, two cam followers each associated with a respective one of the cams, two push rods each engaging a respective one of the two cam followers, a summation linkage engaged by the two push rods and acting on the engine valve, the summation linkage operating in such a manner that the displacement of the valve at any instant is determined by a combination of the displacements of the two cam followers, and a spring acting to ensure that each push rod remains in contact at all times at one end with the associated cam follower and at the other end with the summation linkage.

2. A valve operating mechanism according to claim 1, wherein the two cams are mounted on separate camshafts that are spaced from, and extend parallel to, one another.

3. A valve operating mechanism according to claim 1, wherein the two cams are mounted coaxially with one another.

4. A valve operating mechanism according to claim 1, wherein the summation linkage comprises a rocker mounted on a fixed pivot, one side of the rocker acting on the valve and the opposite side of the rocker pivotally supporting a summation lever engaged by the two pushrods.

5. A valve operating mechanism according to claim 1, wherein the summation linkage comprises a rocker mounted on a fixed pivot, one side of the rocker being engaged by one of the pushrods and the opposite side of the rocker pivotally supporting a lever which acts on the valve and is engaged by the other pushrod.

6. A valve operating mechanism according to claim 1, wherein the spring is a torsion spring acting on the summation linkage.

7. A valve operating mechanism according to claim 1, wherein the spring is a compression spring acting on the summation linkage.

8. A valve operating mechanism according to claim 1, wherein one of the cam followers is formed of two parts that are resiliently biased apart by the spring.

9. A valve operating mechanism according to claim 1, wherein one of the pushrods is formed of two parts that are biased apart by the spring.

10. A valve operating mechanism according to claim 1, wherein a hydraulic lash adjuster is incorporated in one of the cam followers and an adjustable stop is provided to limit the expansion of the hydraulic adjuster.

11. A valve operating mechanism according to claim 1, wherein an adjusting screw is incorporated in the summation linkage to control the clearance in the valve operating mechanism.

* * * * *